US007784782B2

(12) United States Patent
Cook et al.

(10) Patent No.: US 7,784,782 B2
(45) Date of Patent: Aug. 31, 2010

(54) AUTOMATIC SHEET FEED EXTENDER FOR PAPERFEED MODULARITY

(75) Inventors: Brian Dale Cook, Nicholasville, KY (US); David Wayne DeVore, Richmond, KY (US); Daniel Robert Gagnon, Harrodsburg, KY (US); Kris Eren Kallenberger, Richmond, KY (US); David Kyle Murray, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 251 days.

(21) Appl. No.: 11/865,922

(22) Filed: Oct. 2, 2007

(65) Prior Publication Data

US 2009/0085277 A1 Apr. 2, 2009

(51) Int. Cl.
*B65H 1/00* (2006.01)

(52) U.S. Cl. ..... 271/171; 271/145; 399/393

(58) Field of Classification Search ..... 271/171, 271/145; 399/393
See application file for complete search history.

(56) References Cited

U.S. PATENT DOCUMENTS

| | | | | |
|---|---|---|---|---|
| 4,565,360 | A * | 1/1986 | Runzi | 271/4.04 |
| 4,714,243 | A * | 12/1987 | Staniszewski | 271/171 |
| 6,945,528 | B2 * | 9/2005 | Nakamura | 271/171 |
| 7,481,426 | B2 * | 1/2009 | Otsuka et al. | 271/171 |
| 7,547,014 | B2 * | 6/2009 | Okuda et al. | 271/171 |

* cited by examiner

*Primary Examiner*—Saúl J Rodríguez
*Assistant Examiner*—Luis Gonzalez
(74) *Attorney, Agent, or Firm*—John Victor Pezdek

(57) ABSTRACT

A modular print engine assembly for a peripheral comprises an upper paper support, a tray base, the upper paper support pivotally connected to one of the tray base or an extender disposed between the upper paper support and the tray base. The extender allows the modular print engine to be utilized across multiple print models or platforms with housings of various shape and size.

6 Claims, 10 Drawing Sheets

AUTOMATIC SHEET FEED EXTENDER FOR PAPERFEED MODULARITY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to devices having automatic media feed mechanisms and more particularly to a media feed mechanism having a sheet feed extender allowing a print engine to be utilized with various printing peripheral devices of varying housing designs.

2. Description of the Related Art

Inkjet printers and all-in-one devices are generally known to utilize a media input tray and a media output tray defining input and output positions, respectively of a media feedpath. The peripheral devices may comprise an L-shaped paper path wherein an input tray is located at the rear of a printer device and is generally upwardly directed while the media output or exit tray extends horizontally from the front of the device, thereby defining the generally L-shaped feedpath.

One problem with existing print devices and media feeding peripherals is that different print engines must be utilized with different devices, in part due to the changes in media housing or cover shape and size. A print engine comprises at least the media feed assembly. For example, the various market segments may include single function printers, three-in-one devices including print, scan and copy functionality, and four-in-one devices including print, scan, fax and copy functionality. The latter two devices are generally known as all-in-one devices or multi-function peripherals.

Multi-function peripherals generally have housings which are larger than single function printers, typically due to the scanner components being positioned on an upper side of the housing above the print components. In order to compensate for the additional height of the housing, and when an L-shaped feedpath is utilized, the media feeding assembly must be re-designed to accommodate the change in height of the housing. In turn, this requires a different design in the print engine for each peripheral device. Such redesign across various components increases not only the design and testing costs associated with the various devices, but also increases the manufacturing costs.

In addition, one goal of print peripheral manufacturers is to decrease the footprint of the device housing in three dimensions. This aids in allowing for smaller packaging and increased shipping density, which decreases shipping costs per unit. Dimensions within horizontal planes are limited to some extent due to media sizes. However, manufacturers are also limited in vertical planes by the generally upwardly extending input trays. Such upwardly extending trays tend to create packing problems.

It would be desirable if the design of the print engine was modular to allow for use of such print engine across multiple models of printing peripherals. Additionally, it would be desirable to decrease the footprint of the peripheral so as to allow for increased packing density.

SUMMARY OF THE INVENTION

A modular paper feed mechanism comprises an upper tray portion, a lower tray portion, the upper tray portion pivotally connected to one of an extender, disposed between the upper tray portion and the lower tray portion or the lower tray portion. The paper feed mechanism is lengthened when the extender is disposed between the upper tray portion and the lower portion. The modular paper feed mechanism further comprises a movable tray pivot. The extender is utilized with all-in-one devices. The upper tray portion is pivotally connected directly to the lower tray portion. The extender has a first sidewall and a second sidewall. The extender further comprises an extender pivot arm for pivotally connecting the extender to the upper tray portion.

A modular print engine assembly for a peripheral comprises an upper paper support, a tray base, the upper paper support pivotally connected to one of the tray base or an extender disposed between the upper paper support and the tray base. The upper paper support is directly connected to the tray base in a single function device. The extender is utilized in a multi-function peripheral. The modular print engine assembly further comprising a pivotal connection of the upper paper support being movable based on housing size of a peripheral from a first height to a second height. The upper paper support is foldable from a first functional position for media feeding to a second stored position over the peripheral. The tray base further comprises a paper dam. The tray base further comprises opposed base pivot arms.

A modular feedpath assembly comprises a tray base, an upper tray portion, an edge guide slidably connected to the upper tray portion and having a pivot thereon, the upper tray portion pivotally connected to one of the tray base or an extender disposed between the tray base and the upper tray portion. The upper tray portion is pivotable from a stored position to a media feed position. The modular feedpath assembly wherein the tray base defines a portion of a print engine. The modular feedpath assembly further comprises a print engine having the tray base, a carrier assembly and media feed assembly. The modular feedpath assembly wherein the edge guide has an upper portion pivotally connected to a guide arm and the upper portion is slidably connected to the upper tray portion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
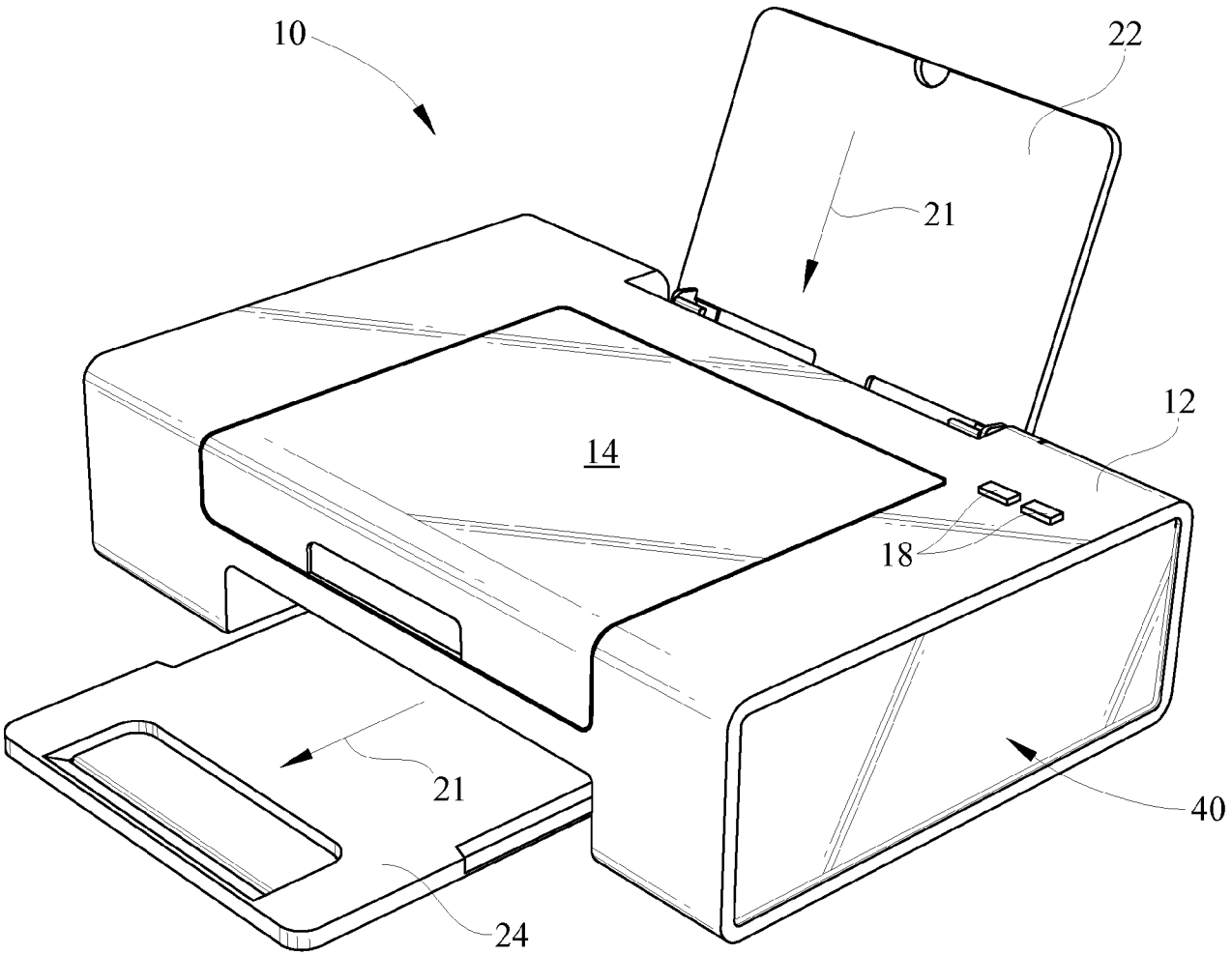
FIG. 1 depicts a perspective view of a single function print peripheral.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiment may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term media and paper may be used interchangeably herein and may include plain paper, photo paper, card stock, transparency, Mylar, fabric, or other printable materials. The term print engine, for purpose of the present application means the at least one media feed assembly but may also include the carrier assembly and the base tray component in combination.

Figure 2:
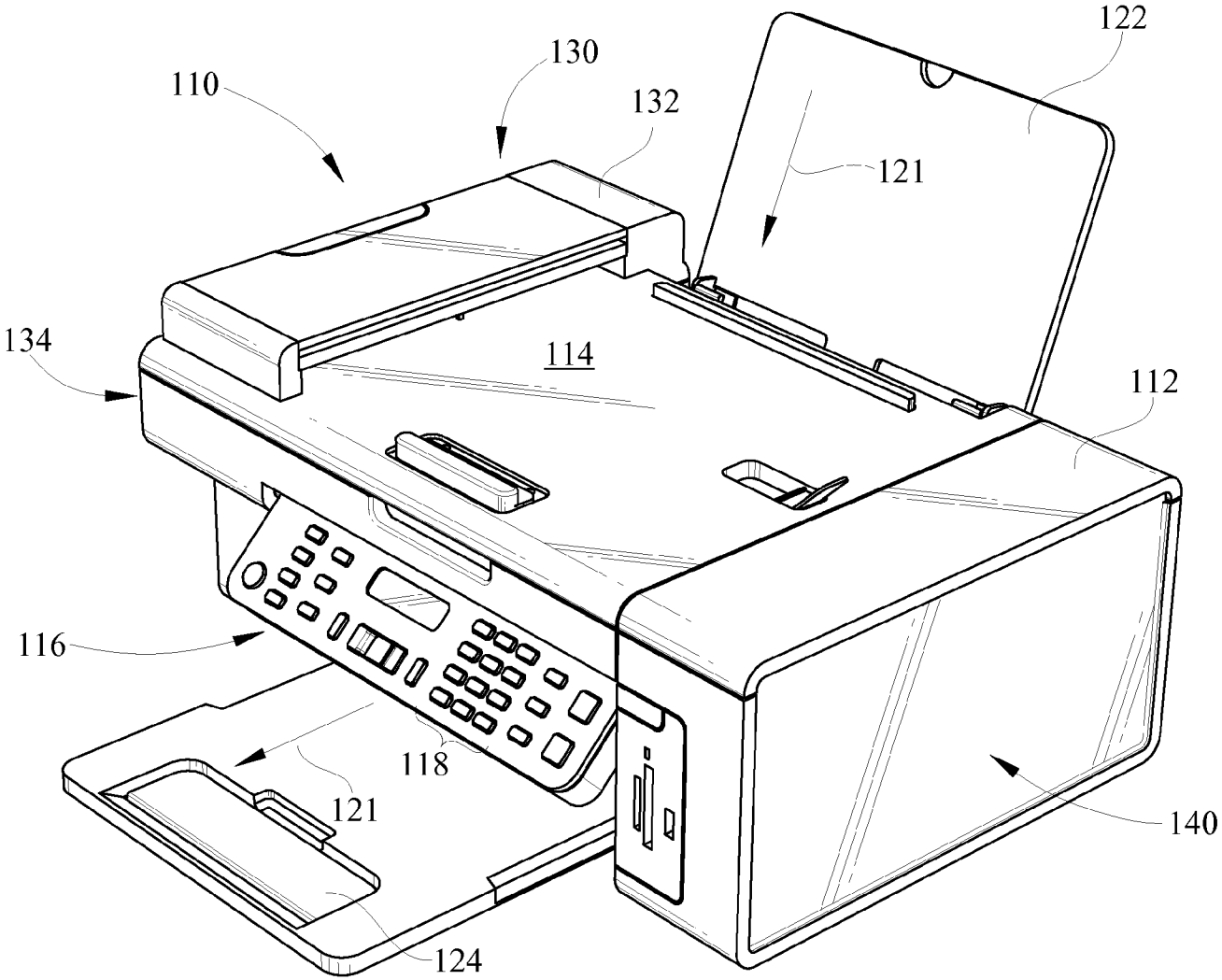
FIG. 2 depicts a perspective view of an all-in-one device or peripheral.

The present device provides an extender for a print engine which renders the print engine usable across many product lines including single function printers and various all-in-one devices each having varying housing shapes. Referring initially to FIG. 1, a single function print peripheral 10 is depicted in a perspective view. The printer 10 comprises a housing 12 within which a print engine 20 (FIG. 4) is positioned. It should be understood that the print engine 20 is utilized in both the single function printer 10 and an all-in-one device 110 described further herein, however, the components described in the description are numbered to distinguish use in the single function peripheral or the all-in-one peripheral. The print engine 20 is defined by at least a paper feed assembly 113 (FIG. 4) and may further comprise a carrier assembly 115 and a tray base 118. In the embodiment of FIG. 1, the print engine 20 does not include an extender 160 (FIGS. 3, 4) due to the lower height of the print device 10 as opposed to an all-in-one device 110, such as shown in FIG. 2 and as will be described further herein. On the upper portion of the housing 12, an access door 14 allows the user to have access to the carrier assembly 115 for changing print cartridges located therein. On the upper surface adjacent the access door are control buttons 18. The printer 10 may also have a display (not shown) or additional buttons included on a control panel for providing additional functionality to the print device 10.

Within in the housing 12 may be a controller (not shown) which may receive data communication from a host computer connected to the print device 10. The controller may be embodied by a micro-processor and controls the various functions of the peripheral 10, 110. Likewise, the controller provides outputs to signal a user of messages, menu selections, error conditions and the like either audibly or visually, or both. A communication connection may be provided by, for example, a parallel cable, a serial cable, a USB cable or via a network connection, either wired or wireless.

Figure 4:
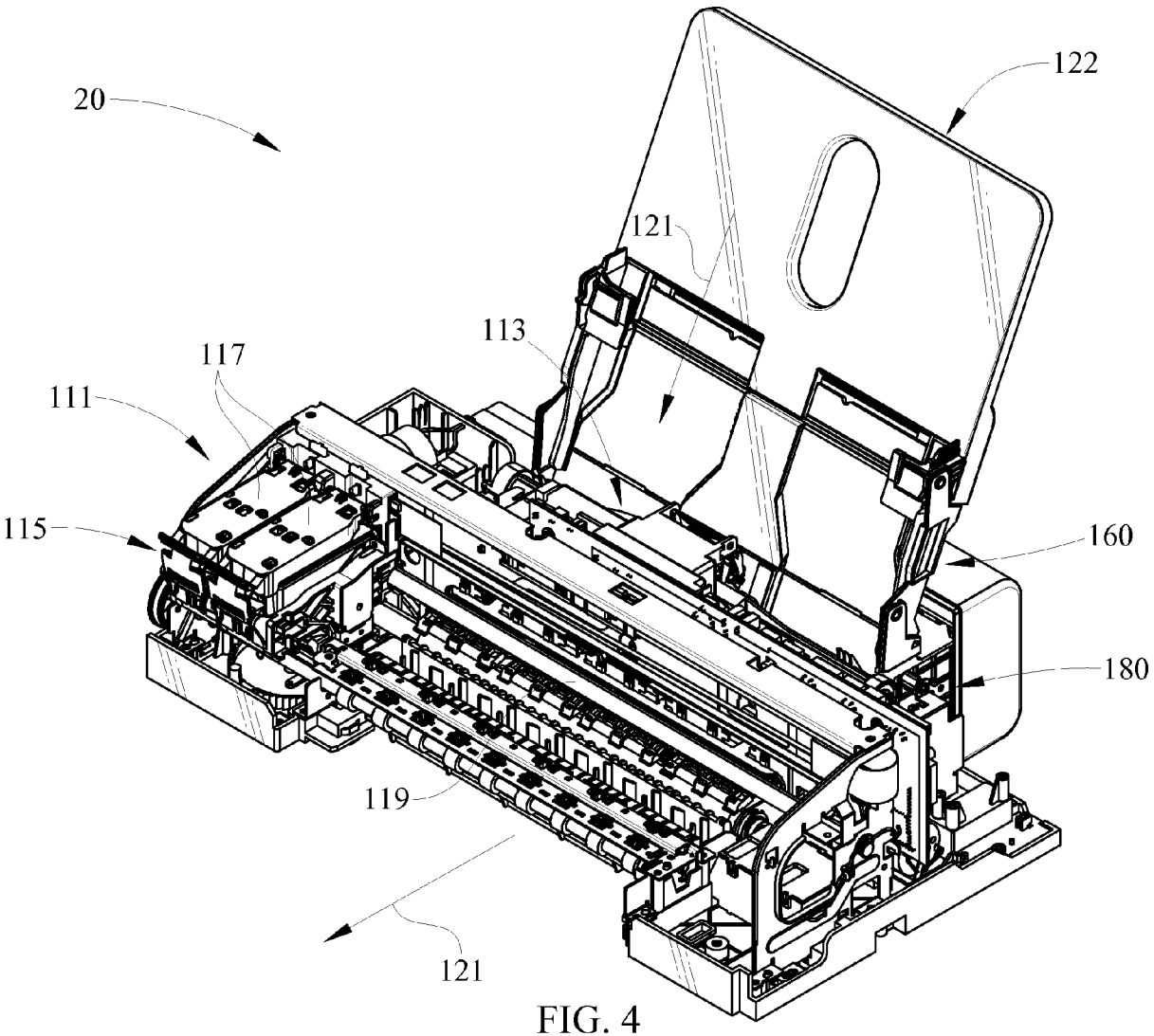
FIG. 4 depicts a perspective view of a print engine assembly for use in either a single function or multi-function peripheral.

Extending through the print device 10 is a media feedpath 21 which begins at an upper input tray or paper support 22 and extends inwardly through the housing 12 adjacent the carrier assembly 115 (FIG. 4). The media feedpath 21 further extends through the printer housing 12 to a front position of the housing 12 at the exit tray 24. In this exemplary L-shaped path, the upper tray 22 is generally upwardly directed while the lower output tray 24 is substantially horizontally extending from the housing 12. The upper tray portion 22 may be pivotally connected such that it folds downwardly over the housing 12 when the printer is not in use. Likewise, the exit tray 24 may be slideably positioned within the housing so that the tray 24 may be retracted when the printer is not in use. These features decrease the peripheral 10 footprint thereby increasing packing density, that is the number of devices, including packaging, which may be stored in a given volume.

Referring now to FIG. 2, a perspective view of an all-in-one device or a multifunction peripheral device is depicted. The all-in-one device 110 utilizes a modular print engine 20 (FIG. 4) which may be alternatively utilized within the printer 10 of FIG. 1 despite the difference in housing shape and the addition of a scanner 130 located above the printer components. The all-in-one device 110 comprises a housing 112. Positioned on an upper portion of the device 110 is a scanner 130 having a lid 114 which is hingedly connected to the housing 112 or a frame of the device. The lid 114 provides access to a flatbed scanner 134 for scanning target images such as photos, drawings or other target images not suitable for auto-document feeding. Positioned on the tray 114 is an auto-document feed scanner 132 which comprises a second scanning means of the scanner 130. The auto-document feed scanner 132 scans a plurality of documents suitable for auto-document feeding and may be used to copy, fax, or digitize documents. Otherwise the flatbed scanner 134 may be utilized. The lid 114 also functions as a tray since media may be positioned thereon and fed into the auto-document feeder 132. Along the front surface of the device 110 is a control panel 116 which comprises a plurality of buttons 118. The control panel and buttons 116, 118 are in communication with a controller (not shown) which controls the various operation components of the device 110 as previously described. Extending from the rear portion of the housing 112 is an upper paper support or input tray 122. The input tray 122 defines a starting point of the media feedpath 121 which passes through the housing 112 and ends at an exit tray 124 extending from the front portion of device 110. As with the printer 10 in FIG. 1, the all-in-one device 110 utilizes an exemplary L-shape feedpath 121 defined by an upwardly extending input tray 122 and a horizontally extending output tray 124. The printer components are not shown specifically but are generally shown depicted as element 140. Due to the additional height of housing 112, the pivot position for element 122 should be moved in order to allow such pivoting and increased packing density, as previously described.

Figure 3:
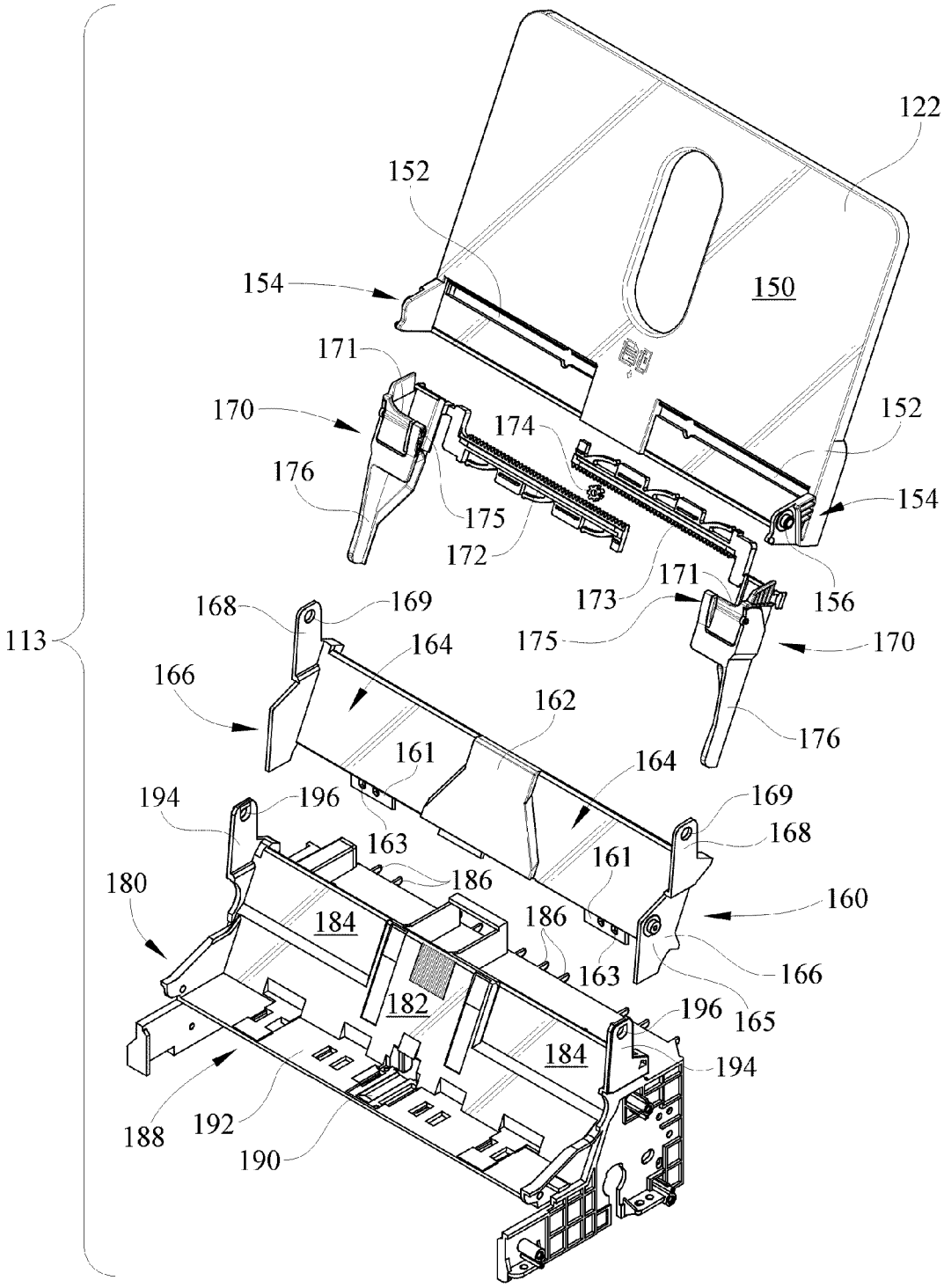
FIG. 3 depicts an exploded perspective view of portions of a print engine including a portion of a media feed assembly for use in an all-in-one peripheral.

Referring now to FIG. 3, a portion of the print engine 20 is depicted in an exploded perspective view. Specifically, the print engine 20 comprises at least a portion of the media feed assembly or mechanism 113. The difference between the print engine 20 of the printer 10 and all-in-one device 110 is that the print engine 20 of device 110 utilizes an extender 160 which is shown in FIGS. 3 and 4. The media feed assembly 113 comprises the structure defining the feedpath as well as the rollers driving the media through the peripheral 10, 110. The print feed assembly 113 comprises an extender 160 which may be disposed between a lower portion of the print engine 20, in the exemplary embodiment a tray base 180, and an upper portion of the print engine 20, in the exemplary embodiment the upper input tray or paper support 122, so as to allow use of the print engine 120 within a print device such as device 10 (FIG. 1) or an all-in-one device 110 having a housing 112 of a larger size than that of the single function printer 10 of FIG. 1. The upper input tray or paper support 122 comprises a surface 150 which supports the media input stack disposed within the tray structure. Near a lower portion of the tray 122 are slides 152 which will be described further herein. Between the slides 152 is a central support 154 which allows for center feeding of media from the tray. Extending from the peripheral edges of the paper support tray 122 are pivot arms 154. Each of the arms 154 has a pivot or hub projection 156 which allows for pivotal connection of the upper input tray 122 to one of either the tray base 180 or an extender 160 depending upon the peripheral 10, 110 in which the print engine 20 is utilized. Thus, one skilled in the art will realize that the extender 160 is not utilized in the peripheral 10, however the components 122, 170, 160, and 180 are interchangeable within the printer 10 and the all-in-one 110.

Adjacent the tray 122 are media edge guides 170. Each of the media edge guides 170 is slidably positioned within one of the slides 152. Each media edge guide 170 further comprises one of a first rack 172 and a second rack 173 which are spaced apart so that a pinion gear 174 may be positioned between each of the racks 172, 173. The pinion gear 174 provides synchronous motion in equivalent distances for each media edge guide 170. Thus the media edge guides 170 are always spaced apart equally and centered relative to a center point of the feedpath 21. Each of the media edge guides 170 further comprises a guide arm 176 extending downwardly and parallel to the media feedpath 121. The media guide arms 176 engage the edges of the media to straighten or align the media with the feedpath 121 direction. By moving the edge guides 170 inwardly or outwardly, the pinion gear 174 rotates and causes each guide arm 176 to move an equivalent distance so as to always maintain the media in an aligned position for center feeding. However, alternative alignment configurations may be utilized such as left feeding justification and right feeding justification. The media edge guide 170 further comprises a pivot 175 which allows the upper portion 171 of guide 170 to pivot with the tray 122 while the lower guide arm 176 remains extended. Such construction inhibits binding when the tray 122 is folded since the guide arms 176 extend beyond the lower edge of tray 122.

Beneath the tray 122 is an automatic sheet feed extender 160 which is a connecting structure located between a tray base 180 and the upper input tray or paper support 122. As previously described, all of the components of FIG. 3 are utilized in both the printer 10 and all-in-one 110 except for the extender 160. The extender 160 lengthens the media input area of the feedpath 121 so that the upper paper support extends from the housing 112 despite the increased height of the housing 112 of the all-in-one device 110 as compared to the single function printer 10. Additionally, and optionally, the extender 160 raises the pivot point of tray portion 22 allowing pivoting of the upper tray 122 despite the increased housing height of device 112. The upper tray portion 22 to be folded downwardly if desirable over the media input area of the device 110. The extender 160 comprises a media support surface 162 with recesses 164 adjacent the centrally located support surface 162. As previously described, the support surface 162 is centrally located in part due to the central media feed design of the exemplary embodiment, however alternative feed designs may be utilized such that a central support area is not required. In addition, the recesses 164 are formed so that as the media edge guides 170 move to align the media, the spacing is provided for the guide arms 176 to move relative to the extender 160. Likewise, the inner edges of the guide arms 176 are formed of a shape complimentary to the sides of the central portion of the support area 162. Extending from the ends of the extender 160 are sidewalls 166 which provide an outer limit for the lateral movement of the media edge guides 170. Extending from the outer surface of the sidewalls 166 is an extender hub projection 165 which will be described further herein. Extending from the support wall of the extender 160 and the upper portion of the sidewall 166 is an extender pivot arm 168. Each extender pivot arm 168 comprises an aperture 169. The apertures 169 and extender pivot arms 168 are spaced apart a distance which corresponds to the spacing between the pivot arms 154 of the upper paper support 122. This allows the apertures 169 to receive the pivot or hub projections 156 connecting the upper tray portion 122 and the extender 160 while providing pivotal motion between parts. Depending from the lower surface of the extender 160 are tabs 161 each having at least one aperture 163. The tab 161 and at least one aperture 163 are utilized to inhibit pivoting of the extender 160 relative to the tray base 180 which is described further herein.

Beneath the extender 160 is the tray base 180. Like the upper tray portion or paper support 122, the tray base 180 is modular in that it may be utilized across various models of single function printers 10 and all-in-one devices 110. The tray base 180 comprises a centrally located media support surface 182 with recesses 184 at each side thereof. The recesses 184 provide a space wherein the media edge guides 170 may move without binding against the rear wall of the tray base 180 when the extender 160 is not utilized. And, alternatively, if the extender 160 is utilized the guide arms 176 may or may not extend across the extender 160 and slide through a portion the recesses 184. As a further alternative, the support surface 182 may extend across all or part of the tray base 180 since the central support area is merely exemplary. Behind the support wall 182 adjacent an upper edge portion of the tray base 180 are a plurality of fingers 186 which engage the holes 163 of the tab 161. The fingers 186 aid with alignment of the extender 160 and tray base 180. Additionally, the fingers 186 inhibit pivoting of the extender 160 relative to the tray base 180. Adjacent a front lower edge of the tray base 180 is a paper jam assembly 188 comprising at least one friction separator or buckler 190 extending from a paper dam 192. The friction separator 190 is centrally located because, as previously described, the devices 10, 110 described herein are generally known as a center feed mechanism.

Extending from the side walls of the tray base 180 are base pivot arms 194. Each of the base pivot arms 194 comprises at least one aperture or hole 196 which receives the respective extender hub or projection 165 of the extender 160. This structure connects the extender 160 and the lower tray base 180 to inhibit rotation there between. However, when the upper tray portion 122 is directly connected to the lower tray portion 180, the upper tray portion 122 may pivot relative to the lower tray base 180. In order to further inhibit pivoting of the extender 160, the lower edge of sidewall 166 is a flat edge. A complimentary flat edge or seat is located on the pivot arms 194 and provides a seat for the lower edge of sidewall 166 to inhibit pivotal motion for example forward folding of the extender 160.

Referring now to FIG. 4, a perspective view of the print engine 20 is depicted. Again, the modular design of the print engine 20 allows its use in printer 10 or all-in-one 110 by merely adding the auto-sheet feed extender 160. According to the exemplary embodiment, the print engine 20 includes the media feed assembly 113 of FIG. 3, a carrier assembly 111 and the tray base 180. The extender 160, as previously described, compensates for variations in height between housings printers, multi-function peripherals, all-in-one devices and the like so that a single print engine 120 may be implemented in various models by the addition or removal of the extender 160. The media feed assembly 113 may also comprise an auto-compensating mechanism or other pick device which is centrally located along the feedpath 21 as well as other media feed structure defining the media path. The auto-compensating mechanism picks media from a stack supported within the media feed assembly 113 to begin the feeding process toward the printer 10.

The controller also directs the print or carrier assembly 111 mounted to the media feed assembly 113. A slide bar or slide rail 119 extends between ends of the carrier assembly 111 to slidably support the carriage 115. The slide rail 119 extends substantially transverse to the media feedpath 121 so that the carriage 115 may slide in a direction also substantially transverse to the feedpath 121, extending from the input support tray 122 through the housing 112 to the exit tray 124. The carriage 115 moves along the slide rail 119 in a direction which is substantially transverse to the media feedpath 121, and which extends from the first tray 22 through the device 10, 110 to the second tray 24. The carrier assembly 111 may also utilize a feedback loop, as will be understood by one skilled in the art to continually ascertain the position of the carrier 115 on the slide rail 119. The carriage 115 houses at least one cartridge 117 containing ink and a printhead for selectively ejecting ink onto media passing in a print zone defined beneath the carriage 115 and within the body 12. According to the exemplary embodiment, the carriage 115 houses two cartridges one for color printing, containing for example, cyan, magenta and yellow color inks as well as a second cartridge which may contain black ink for printing text gray-scale and non-color documents.

Figure 5:
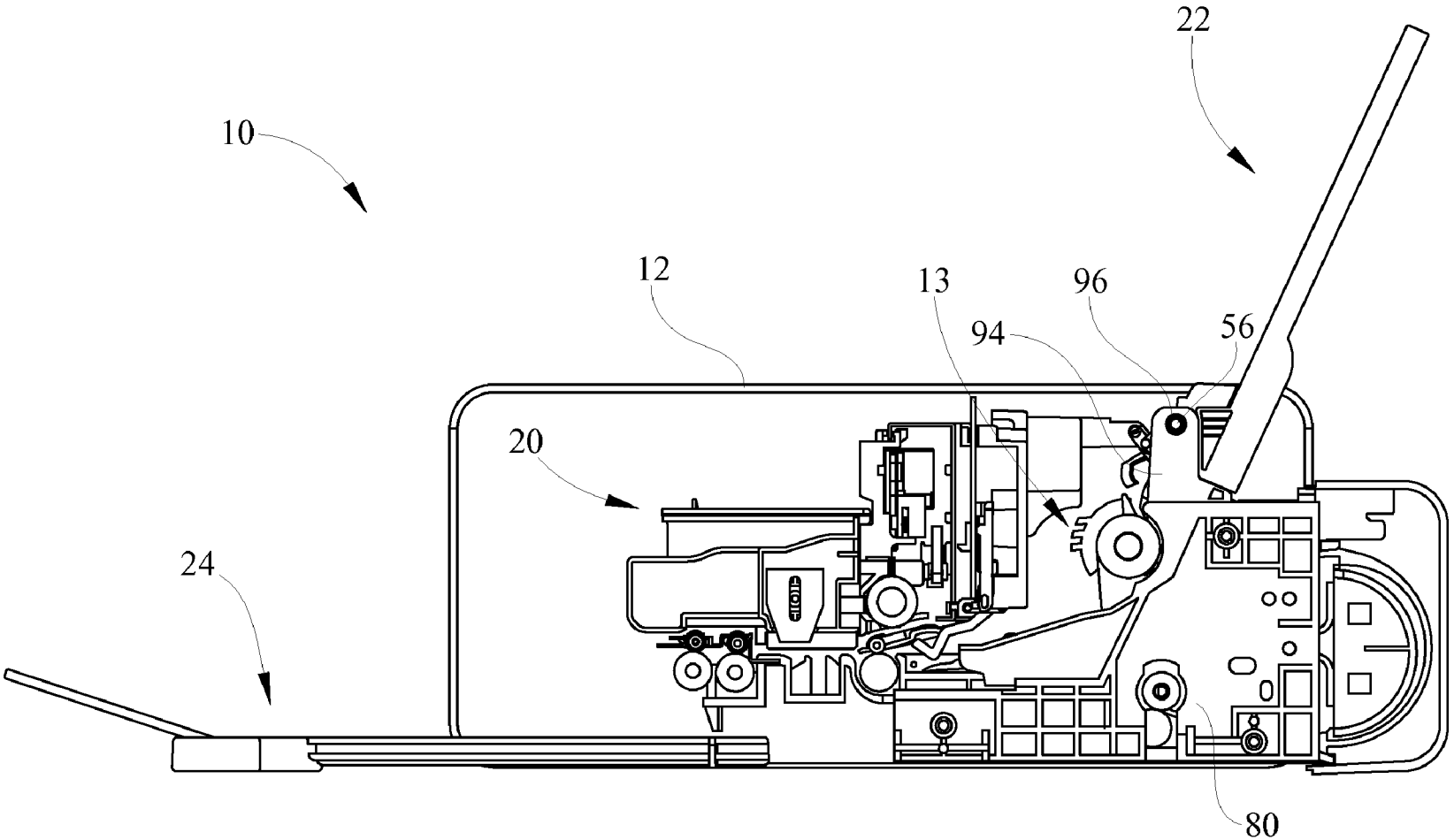
FIG. 5 depicts a side view of the single function peripheral of FIG. 1 with the housing cut-away.
Figure 6:
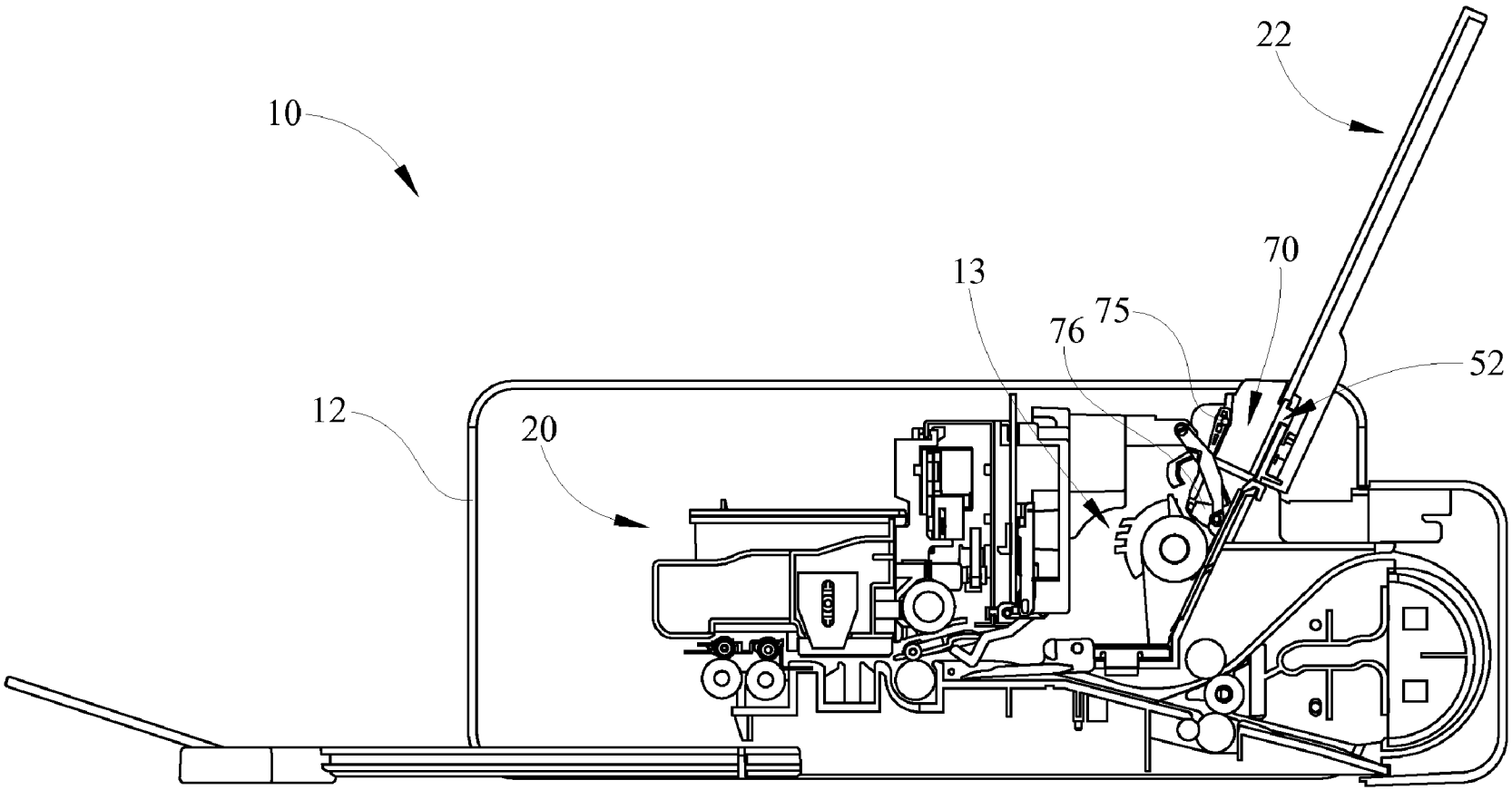
FIG. 6 depicts a sectional view of the peripheral of FIG. 5 with the upper tray portion in an upright feeding position.
Figure 7:
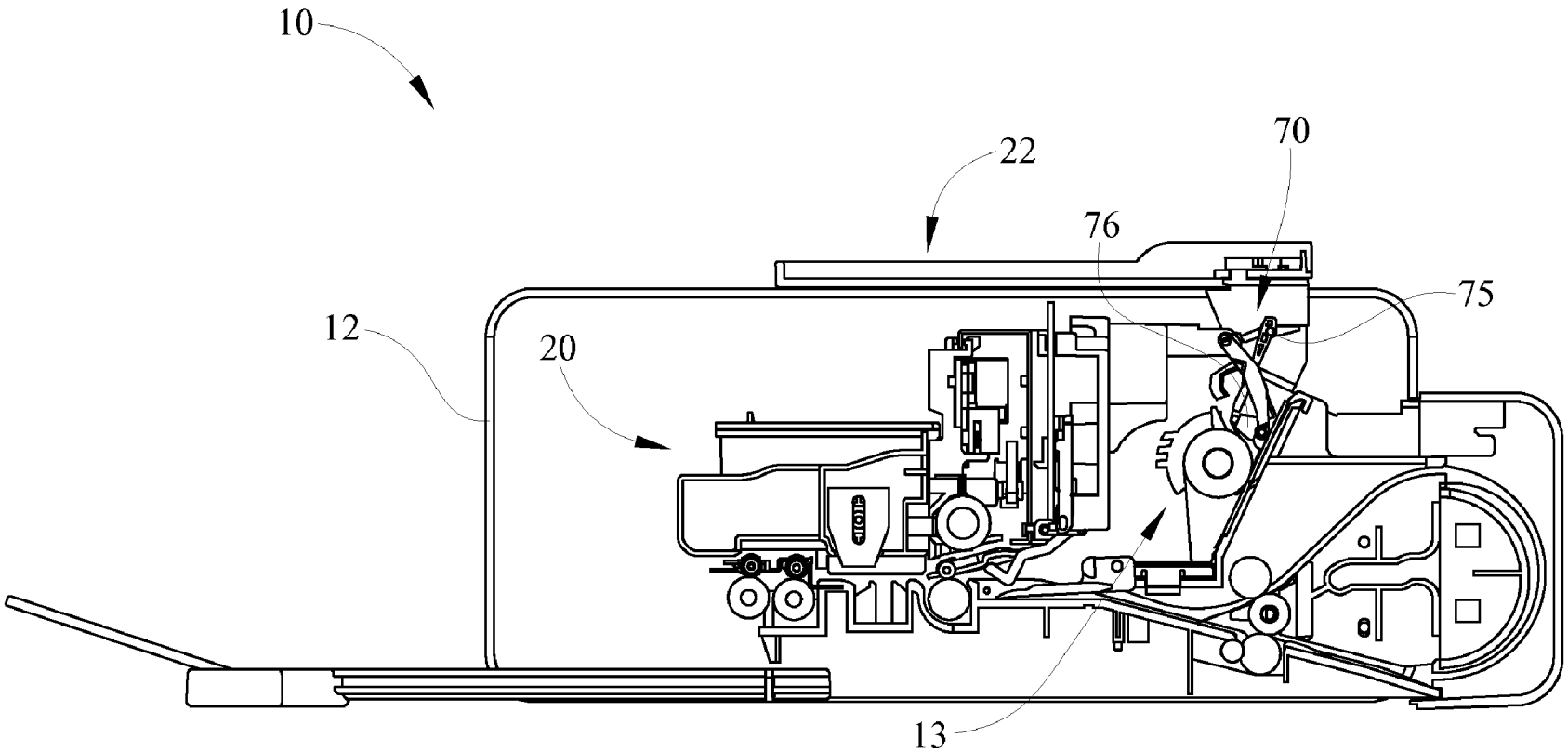
FIG. 7 depicts a sectional view of the peripheral of FIG. 5 with the upper tray portion folded into a stored position.

Referring now to FIGS. 5, 6 and 7, the single function peripheral 10 is shown in a side view (FIG. 5) and section views (FIGS. 6 and 7). The modular print engine 20 is depicted within the housing 12. Although the print engine 20 used in the single function peripheral 10 is the same as the peripheral 110, except for the addition of the extender 160, the numerals indicating the various components of the print engine 20 differ from the components in FIG. 3 only to distinguish between the single function peripheral 10 and the all-in-one device 110. The upper tray or paper path 22 is connected to the lower tray portion or tray base 80 at a base pivot arm 94. The tray pivot arm 54 includes a hub projection 56 which extends through aperture 69. This construction allows pivotal rotation of the upper tray 22 so that the tray may be positioned in a substantially upright orientation for media feeding or a downward position which allows increased packing density for shipping the products.

As shown in FIG. 6, the section view depicts the peripheral 10 in section view such that the pivotal connection at pivot arm 54 and base pivot arm 94 is removed revealing an inner pivot 75 on the media guide 70. As one skilled in the art will understand, the media guides 70 slide along the tray 22 within slides 52 as previously described. Due to the pivotal movement of the upper tray portion 22 and the length of the media guides 70, which extend beyond the lower edge of the upper tray portion 22, without such pivot 75 the media guides 70 would bind on the tray base 80 inhibiting rotation of the upper tray portion 22. In order to overcome such limitation, Applicants have utilized the pivot hinge 75 on the media guide 70 allowing the guide arm 76 to pivot relative to the upper portion of the media guide 70 which is slidably connected to the upper tray portion 22.

As shown in FIG. 7, the media guide 70 is rotated in part with the upper tray portion 22 while the pivot 75 and guide arm 76 remain stationary and extend downwardly toward the tray base 180. Due to this pivoting design of the media guide 70, the tray 22 can pivot downwardly for increased packing density. The pivot at hub projection 56 as well as the pivot at 75 allow folding of the upper tray portion 22 when the upper tray portion is connected to the tray base 80.

Figure 8:
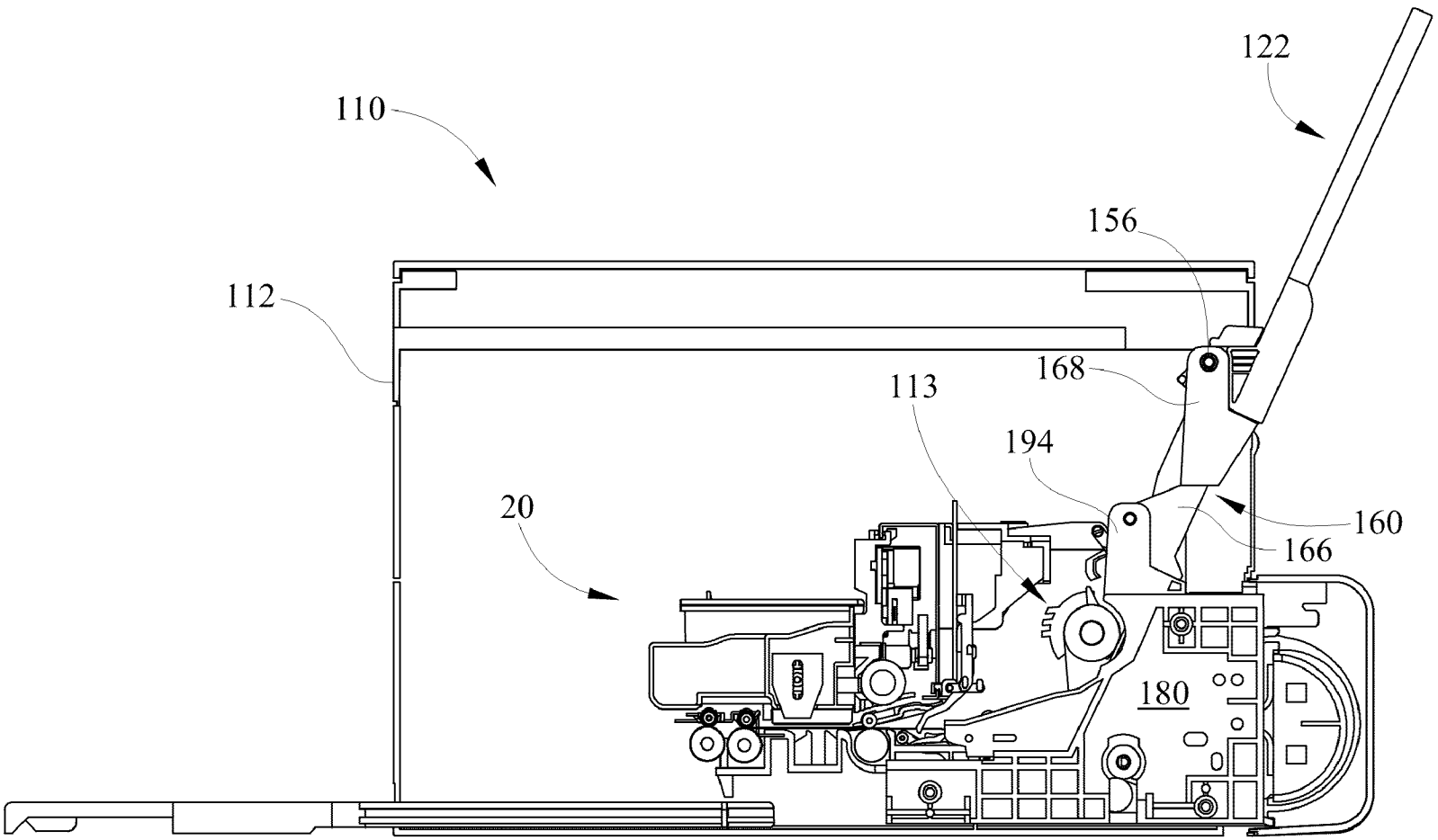
FIG. 8 is a side view of the all-in-one peripheral of FIG. 2 with the housing cut-away and the upper tray portion in an extended position.
Figure 9:
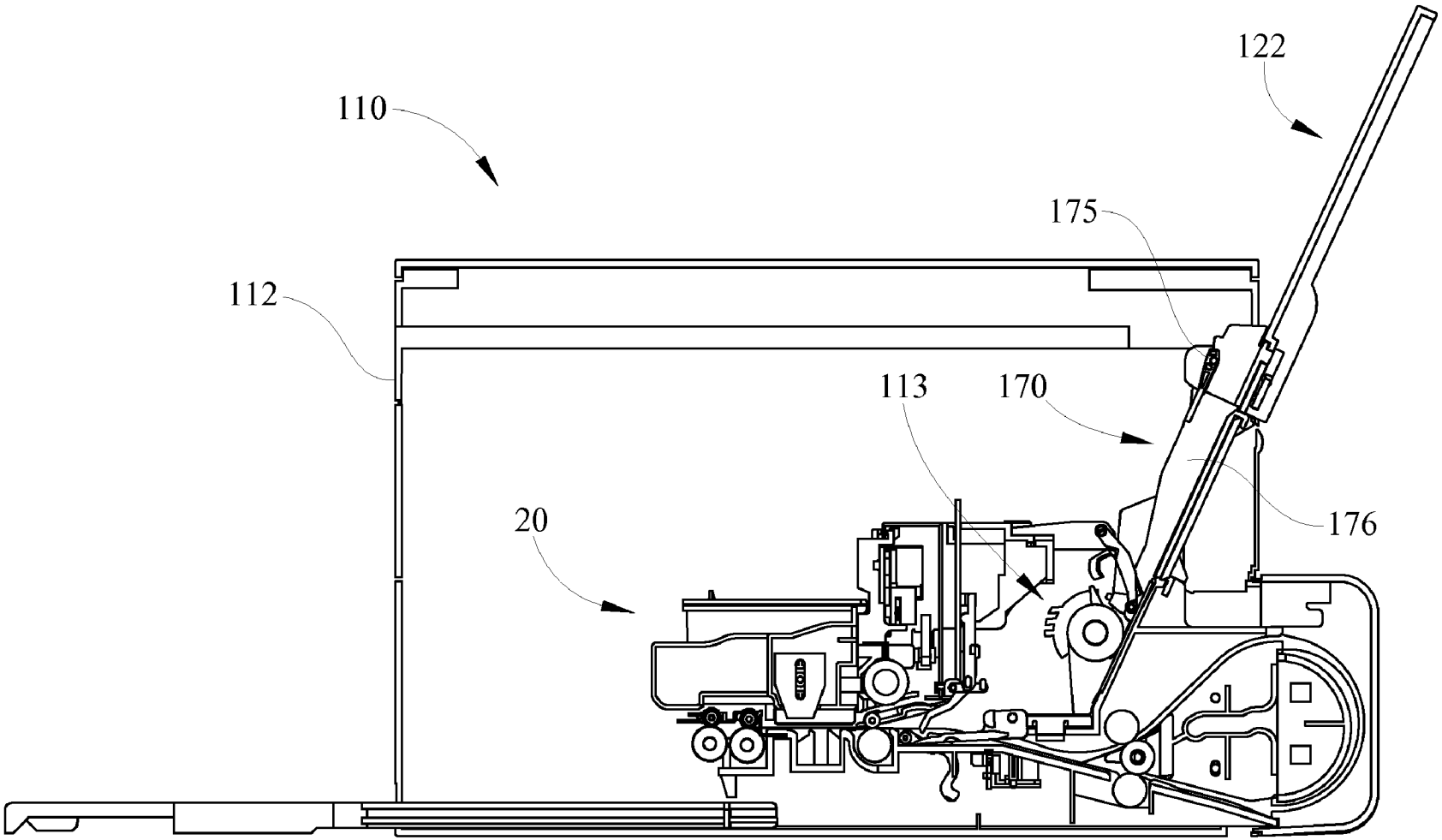
FIG. 9 is a side-sectional view of the all-in-one peripheral of FIG. 2 with the upper tray portion in an extended position; and, FIG. 10 is a side-sectional view of the all-in-one peripheral of FIG. 2 with the upper tray portion in a folded position.
Figure 10:
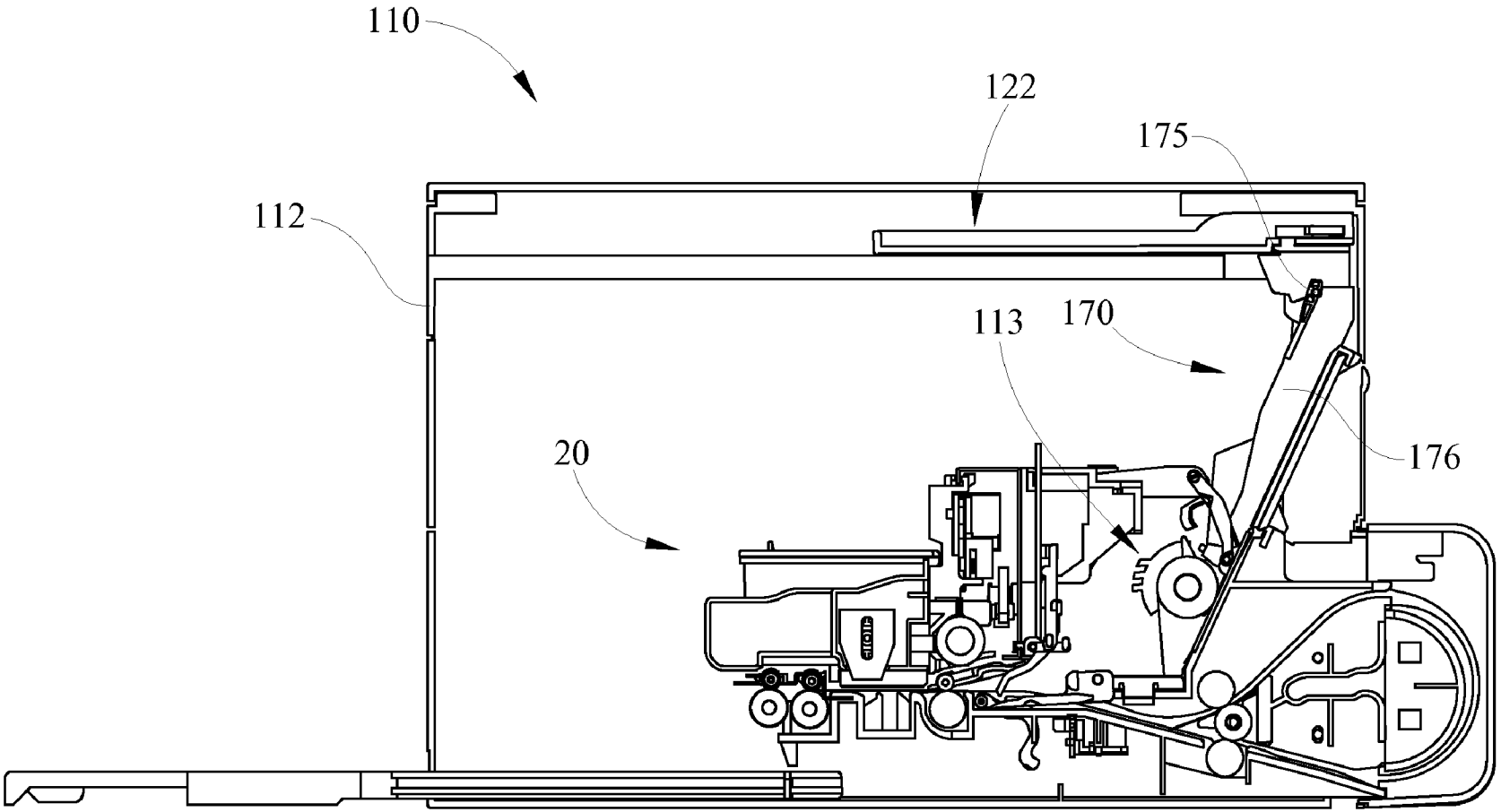

Referring now to FIGS. 8, 9 and 10, the all-in-one peripheral 110 is shown in a side view (FIG. 8) and two section views (FIGS. 9 and 10). As with the peripheral 10 previously described, the peripheral 110 utilizes a print engine 20 which may be modular and therefore interchanged with that print engine 20 of the peripheral 10. Such modularity across product lines is desirable in order to allow for on demand manufacturing, for example, if higher-than-normal sales are forecast for all-in-one devices. Likewise, it is desirable to provide a folding upper tray portion 122 such that the media tray may be folded downwardly to decrease the overall height of the peripheral 110 and allow for increased packing density. Such increase in density decreases shipping costs of the peripheral. However, due to the increased height of the housing 112, the ability to rotate the upper tray portion 122 relative to the tray base 180 is inhibited when the upper tray portion 122 is connected to the tray base 180 as previously described with peripheral 10. In addition, the ability to utilize the same print engine 20 as described with peripheral 10 is highly desirable in order to decrease manufacturing and testing costs among various printing peripherals. In order to allow the use of a single print engine within multiple peripheral housings, the all-in-one peripherals such as peripheral 110, comprise an extender 160 between the upper tray portion 122 and the lower tray portion 180. The extender 160 effectively raises the pivot position of the upper tray portion 122 so that the upper tray 122 can pivot and rest along an upper surface of the housing 112. With this movable pivot position, a single print engine may be utilized. As clearly indicated in FIG. 8, a pivot 156 is raised from the tray base 180 to an elevated position on the extender pivot arm 168. Meanwhile, the side wall 166 is connected to the base pivot arm 194 by pivot 165.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A modular feedpath assembly, comprising:

a tray base;

an upper tray portion;

an edge guide slidably connected to said upper tray portion and having a pivot thereon, said edge guide further comprising a guide arm extending beyond the lower edge of the upper tray portion; and said upper tray portion pivotally connected to one of said tray base or an extender disposed between said tray base and said upper tray portion with said guide arm extending over a surface of said tray base and said extender.

2. The modular feedpath assembly of claim 1 wherein said upper tray portion is pivotable from a stored position to a media feed position.

3. The modular feedpath assembly of claim 1 wherein said tray base defines a portion of a print engine.

4. The modular feedpath assembly of claim 1 further comprising a print engine having said tray base, a carrier assembly and media feed assembly.

5. The modular feedpath assembly of claim 1 wherein said edge guide has an upper portion pivotally connected to the guide arm.

6. The modular feedpath assembly of claim 5 wherein said upper portion is slidably connected to said upper tray portion.

* * * * *